US005892488A

United States Patent [19]

Dulon

[11] Patent Number: 5,892,488

[45] Date of Patent: Apr. 6, 1999

[54] CB ANTENNA TRUCK MOUNT

[76] Inventor: Thomas Dulon, 1203 Co. Rd. V, Hudson, Wis. 54016

[21] Appl. No.: 779,848

[22] Filed: Jan. 7, 1997

[51] Int. Cl.[6] ..... H01Q 1/12; H01Q 1/32

[52] U.S. Cl. ..... 343/892; 343/713

[58] Field of Search ..... 343/713, 715, 343/878, 892; 248/200, 205.1; H01Q 1/32

[56] References Cited

U.S. PATENT DOCUMENTS 2,269,947 1/1942 Ludwig ..... 343/892
2,312,107 2/1943 Mace et al. ..... 343/892

*Primary Examiner*—Michael C. Wimer

[57] ABSTRACT

A new CB Antenna Truck Mount for providing a new and improved CB antenna mount that is strong and easily installed without any deleterious affects to the vehicle. The inventive device includes a mounting arm and a cup shaped mount.

2 Claims, 2 Drawing Sheets

CB ANTENNA TRUCK MOUNT

BACKGROUND OF THE INVENTION

1. Field of the Invention

The present invention relates to antenna mount assemblies and more particularly pertains to a new CB antenna truck mount for providing a new and improved CB antenna mount that is strong and easily installed without any deleterious affects to the vehicle.

2. Description of the Prior Art

The use of antenna mount assemblies is known in the prior art. More specifically, antenna mount assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art antenna mount assemblies include U.S. Pat. No. 4,114,159; U.S. Pat. No. 4,249,182; U.S. Pat. No. 361,067; U.S. Pat. No. 357,922; U.S. Pat. No. 4,151,533 and U.S. Pat. No. 4,028,705.

While these devices fulfill their respective, particular objectives and requirements, the aforementioned patents do not disclose a new CB antenna truck mount. The inventive device includes a mounting arm and a cup shaped mount.

In these respects, the CB antenna truck mount according to the present invention substantially departs from the conventional concepts and designs of the prior art, and in so doing provides an apparatus primarily developed for the purpose of providing a new and improved CB antenna mount that is strong and easily installed without any deleterious affects to the vehicle.

SUMMARY OF THE INVENTION

In view of the foregoing disadvantages inherent in the known types of antenna mount assemblies now present in the prior art, the present invention provides a new CB antenna truck mount construction wherein the same can be utilized for providing a new and improved CB antenna mount that is strong and easily installed without any deleterious affects to the vehicle.

The general purpose of the present invention, which will be described subsequently in greater detail, is to provide a new CB antenna truck mount apparatus and method which has many of the advantages of the antenna mount assemblies mentioned heretofore and many novel features that result in a new CB antenna truck mount which is not anticipated, rendered obvious, suggested, or even implied by any of the prior art antenna mount assemblies, either alone or in any combination thereof.

To attain this, the present invention generally comprises a mounting arm and a cup shaped mount.

There has thus been outlined, rattler broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new CB antenna truck mount apparatus and method which has many of the advantages of the antenna mount assemblies mentioned heretofore and many novel features that result in a new CB antenna truck mount which is not anticipated, rendered obvious, suggested, or even implied by any of the prior art antenna mount assemblies, either alone or in any combination thereof.

It is another object of the present invention to provide a new CB antenna truck mount which may be easily and efficiently manufactured and marketed.

It is a further object of the present invention to provide a new CB antenna truck mount which is of a durable and reliable construction.

An even further object of the present invention is to provide a new CB antenna truck mount which is susceptible of a low cost of manufacture with regard to both materials and labor, and which accordingly is then susceptible of low prices of sale to the consuming public, thereby making such CB antenna truck mount economically available to the buying public.

Still yet another object of the present invention is to provide a new CB antenna truck mount which provides in the apparatuses and methods of the prior art some of the advantages thereof, while simultaneously overcoming some of the disadvantages normally associated therewith.

Still another object of the present invention is to provide a new CB antenna truck mount for providing a new and improved CB antenna mount that is strong and easily installed without any deleterious affects to the vehicle.

Yet another object of the present invention is to provide a new CB antenna truck mount which includes a mounting arm and a cup shaped mount.

Still yet another object of the present invention is to provide a new CB antenna truck mount that can be transferred from one vehicle to another.

Even still another object of the present invention is to provide a new CB antenna truck mount that allows any style of antenna to be mounted to a truck and is able to remain attached to a truck even when driven in heavily wooded areas.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
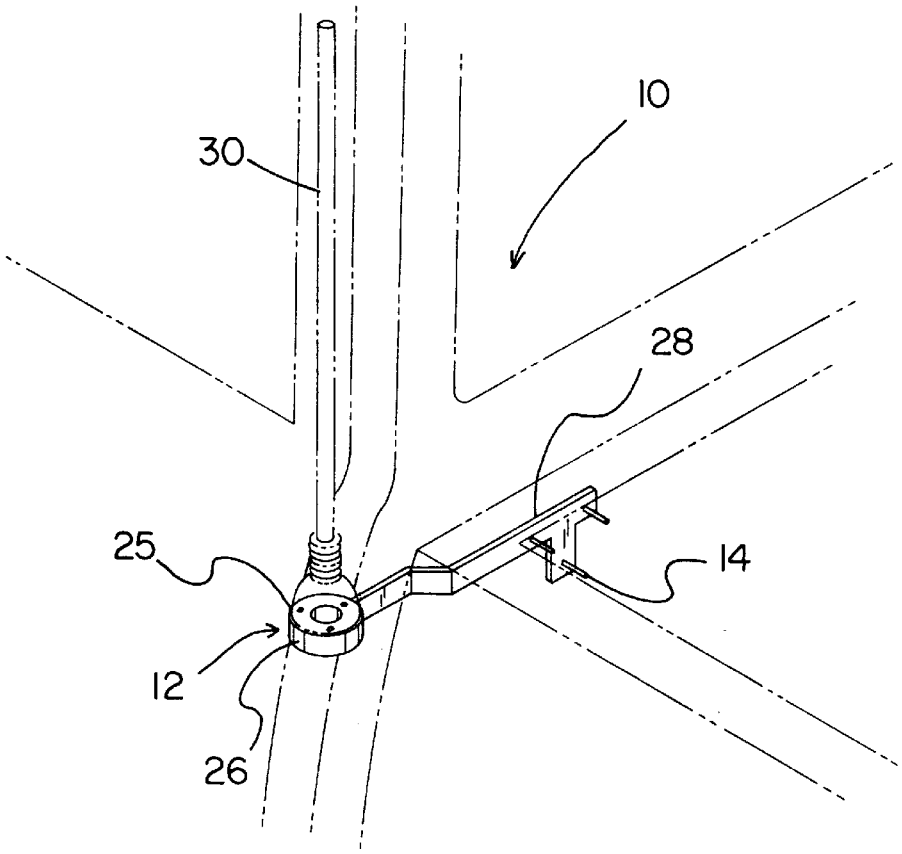
FIG. 1 is a side perspective view of a new CB antenna truck mount according to the present invention.
Figure 2:
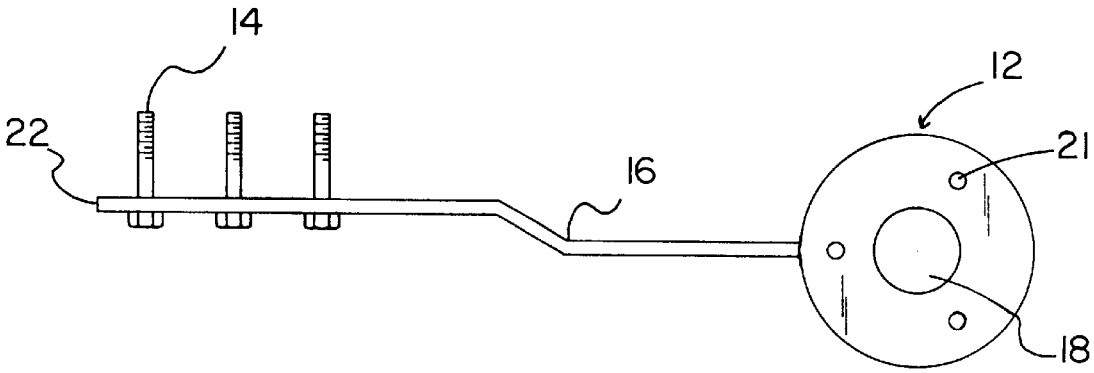
FIG. 2 is a top view thereof.
Figure 3:
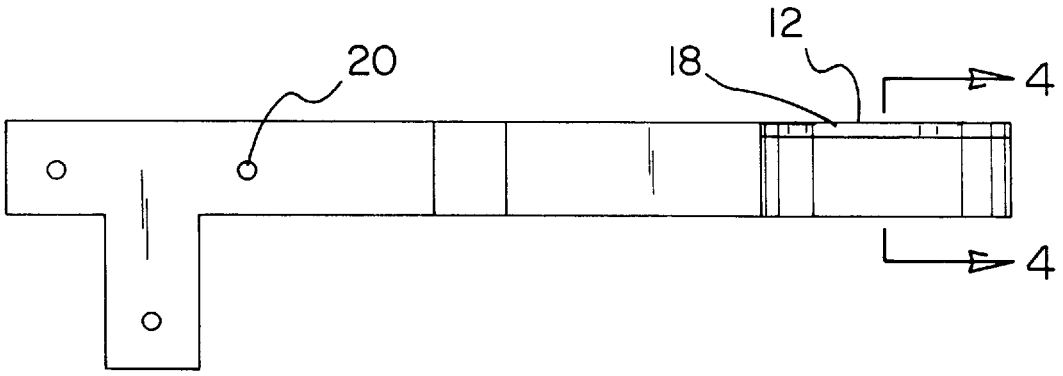
FIG. 3 is a side view of the present invention.
Figure 4:
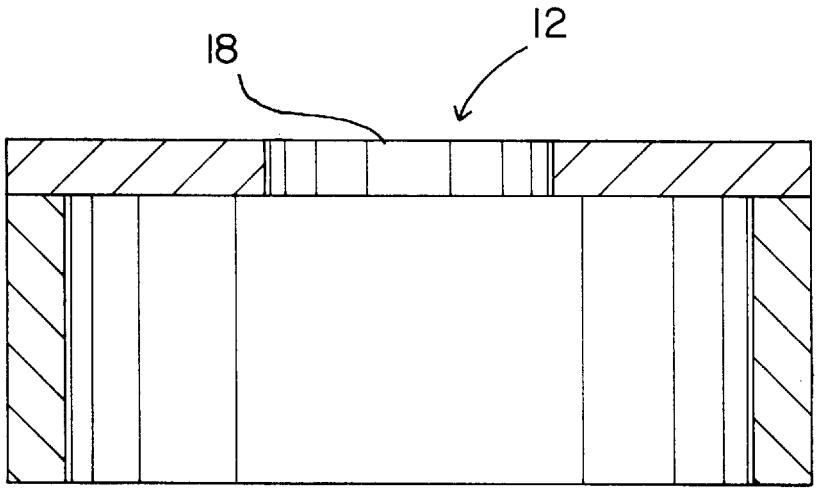
FIG. 4 is a cross sectional view taken along line 4—4 of FIG. 3.

With reference now to the drawings, and in particular to FIGS. 1 through 4 thereof, a new CB antenna truck mount embodying the principles and concepts of the present invention and generally designated by the reference numeral 10 will be described.

More specifically, it will be noted that the CB antenna truck mount 10 comprises a mounting arm and a cup shaped mount.

As best illustrated in FIGS. 1 through 4, it can be shown that the present invention teaches a novel and nonobvious CB antenna truck mount that finds use in the industry.

The present invention generally includes A CB antenna truck mount 10 which includes: a mount arm 16 fixedly attached at one end 22 of the mount arm 16 to a round mount 12. The round mount 12 comprises an annular member and a cover member. The cover member includes a central aperture 18 and holes 21 spaced around the central aperture 18. Although it may be possible for the mount to be of differing shapes, a round mount is preferred in the present invention. The round mount 12 forms an upper circular means 25 and a lower circular means 26. The mount arm 16 includes a first portion, offset portion and an attachment portion to fit a front edge of a truck box 28, thus allowing a truck mount 10 to be positioned to provide good reception yet not hinder the use of other truck accessories. The attachment portion includes apertures 20 for attaching the mount arm to the truck box.

The mount arm 16 is removably attached to a truck, wherein the mount arm 16 extends for at least about 6 inches then forms an angle of about 30° for about 1 inch then continues as a longitudinal piece for about 3½ inches. The mount arm 16 forms a T shape, and further comprises at a first end 22 about three screwing means 14. The screwing means 16 are fixedly attached to the arm 16 and used for attaching the mount 10 to the truck. The mount 10 can me made of metal or plastic, however it is preferably made of metal. The lower circular means 26 measures about 3½ inches in outer diameter, and the upper circular means 25 has a diameter opening which measures abut 1¼ inch. The antenna 30 is removably inserted into the opening of the upper circular means 25. Since the uniqueness of this invention allows the mount to be attached at the froth edge of the truck box 30, the antenna mount measure about 14 inches long about 3⅓ inches wide and about 4 inches tall.

Not shown is the wires that are used to connect the CB antenna. Advantageously, the present invention 10 allows the wires to be run through the truck fire wall or be fed through a hole of about ¼ inch under the truck. The present invention can also be painted any color to match the vehicle is being installed onto.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An antenna mounting system comprising:

an annular member having a planar cover member coupled thereto, the cover member having a central aperture therein, the cover member further including a plurality of holes positioned in spaced relationship with respect to each other around the central aperture;

an elongate mount arm having a longitudinal extent in a generally horizontal direction, the mount arm having a transverse width extending in a substantially vertical plane, the mount arm having a planar first portion being extended radially outward from the annular member, the mount arm having an offset portion extending from the first portion, the offset portion having a longitudinal extent offset from the longitudinal extent of the first portion, the mount arm further having a planar generally T-shaped attachment portion extending from the offset portion, the attachment portion having a plurality of apertures therein adapted for attaching the mount arm to a forward wall of a truck bed;

wherein the holes in the cover member are adapted for coupling to a base of an antenna;

wherein the central aperture in the cover member is adapted for receiving an antenna cable therethrough; and wherein the cover member is adapted for coupling to the base of the antenna such that the base covers the cover member to prevent debris from entering the annular member through the central aperture.

2. An antenna mounting system comprising, in combination:

an antenna having a generally circular base and a cable extending outwardly from a center of a lower surface of the base;

an annular member having a planar cover member coupled thereto, the cover member having a central aperture therein, the cover member further including a plurality of holes positioned in spaced relationship with respect to each other around the central aperture;

an elongate mount arm having a longitudinal extent in a generally horizontal direction, the mount arm having a transverse width extending in a substantially vertical plane, the mount arm having a planar first portion being extended radially outward from the annular member, the mount arm having an offset portion extending from the first portion, the offset portion having a longitudinal extent offset from the longitudinal extent of the first portion, the mount arm further having a planar generally T-shaped attachment portion extending from the offset portion, the attachment portion having a plurality of apertures therein adapted for attaching the mount arm to a forward wall of a truck bed;

the holes in the cover member being for coupling the cover member to the base of the antenna;

the central aperture in the cover member being for receiving the cable therethrough; and the cover member being for coupling to the base of the antenna such that the base covers the cover member to prevent debris from entering the annular member through the central aperture.

* * * * *